United States Patent [19]

Popper

[11] 4,062,604

[45] Dec. 13, 1977

[54] BAG HOLDER

[76] Inventor: Peter Popper, Favoritenstr. 130, Wien X, Austria

[21] Appl. No.: 709,909

[22] Filed: July 29, 1976

[30] Foreign Application Priority Data

July 30, 1975 Austria ..... 5902/75

[51] Int. Cl.[2] ..... B65D 91/00; B65B 67/04

[52] U.S. Cl. ..... 312/211; 248/99; 312/328

[58] Field of Search ..... 312/211, 212, 328, 329, 312/275; 248/97, 99, 101

[56] References Cited

U.S. PATENT DOCUMENTS

| | | | |
|---|---|---|---|
| 3,374,976 | 3/1968 | Kurlander | 248/97 |
| 3,655,157 | 4/1972 | Dalton | 248/97 |
| 3,788,720 | 1/1974 | Schneider | 248/99 |
| 3,861,125 | 1/1975 | Hagemeister | 248/99 |

*Primary Examiner*—Casmir A. Nunberg
*Attorney, Agent, or Firm*—Karl F. Ross

[57] ABSTRACT

A bag holder comprises a fixed arm which is swingable about a vertical axis and a movable arm pivotally mounted to swing relative to the fixed arm about a horizontal axis and controlled by a rod so that, when the fixed arm is swung about its vertical axis, the movable arm is swung at its upper end away from the fixed arm to spread the mouth of a bag retained by gripper elements at the top of both arms. Below these gripper elements, the arms are provided with bars which press the mouth of the bag closed so that, when the upper end of the movable arm is swung toward the upper end of the fixed arm, the sealing bars come into play.

8 Claims, 5 Drawing Figures

BAG HOLDER

FIELD OF THE INVENTION

The present invention relates to a bag holder adapted to receive a bag and designed to open and close the mouth thereof. More particularly, the invention relates to a holder for hanger-type bags provided with handles or the like which can be received in the holder so as to automatically open to accept trash and the like.

BACKGROUND OF THE INVENTION

Bag holders designed to receive trash, kitchen wastes and the like have been provided heretofore and generally comprise a frame or the like retaining the bag in an open position. In some systems, a closure element is provided above the bag-support frame so as to close the mouth of the bag. Such systems have not been convenient for all purposes and are not always the most sanitary.

Other arrangements require the actuation of a pedal, lever or other device for opening the mouth of the bag, a system which is inconvenient and cannot always be accommodated to the requirements of a kitchen or other location in which the bag is to be used.

Bags which are for convenience termed "hanger bags" generally have a pair of handles which can be spread apart to open the bag. Such systems cannot be accommodated in most of the conventional kitchen devices for supporting trash bags, garbage bags and the like.

OBJECTS OF THE INVENTION

It is the principal object of the present invention to provide an improved bag holder adapted to accommodate hanger bags and to provide a more sanitary technique for retaining the same.

Another object of the invention is to provide a bag holder for the purposes described which can be more readily accommodated to kitchen needs.

SUMMARY OF THE INVENTION

These objects and others which will become apparent hereinafter are attained, in accordance with the present invention, in a bag holder which comprises a first arm, pivotally mounted so as to swing about a vertical axis and preferably forming part of a cabinet door or mounted upon a cabinet door, a second arm swingable relative to the first arm about a horizontal axis so that the upper end of the second arm can approach or recede from the first arm, respective sealing bars provided at the upper ends of the arms so as to hold a bag closed across the entire width of the bag at its mouth, and gripper means above the sealing bars adapted to engage handles on the bag. This arrangement has the advantage that the handles of the bag can simply be engaged with the grippers at the upper ends of the arms and the mouth of the bag opened by swinging the second arm about the horizontal axis away from the upper end of the first arm.

Advantageously, spring means is provided to urge the sealing bars toward one another in the closed condition of the holder, thereby pressing the lips of the bag together and forming a closure therefor.

The vertical swinging axis for the first arm, which may be formed by a door of a cabinet, allows the entire bag holder to be mounted in a cabinet and to be swung outwardly with the door about the aforementioned vertical axis. Advantageously, a tension member is provided between the movable second arm and the cabinet so as to draw the upper end of the second arm away from the upper end of the first arm for automatically opening the mouth of the bag when the door of the cabinet is opened.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
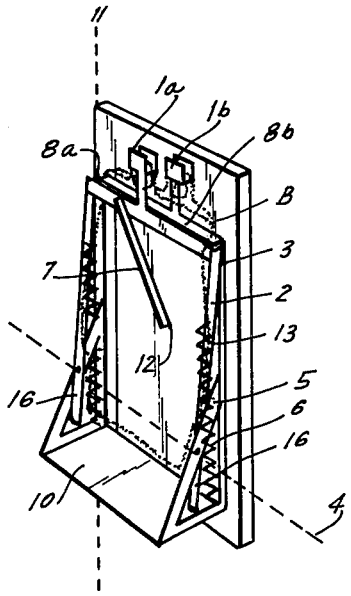
FIG. 1 is a diagrammatic perspective view showing the bag holder of the present invention in its closed condition, the bag being illustrated in broken lines and the remainder of the cabinet having been omitted for purposes of clarity.

In the drawing, I show a bag holder which comprises a fixed arm 3 and a movable arm 2, the latter being hinged to the former about a horizontal axis 4. More particularly, the fixed arm 3 comprises a frame having a pair of vertical members, a bottom plate 10, an upper sealing bar **8*b*, and a pair of struts 5 reaching to the free end of the plate 10** upon which the bottom of the bag can rest.

The movable arm 2 also comprises a pair of vertical legs, each of which is hinged at 31 to one of the struts 5 to define the pivot 4 and an upper horizontal bar **8*a*** serving as one of the sealing bars.

Above the sealing bars **8*a* and 8*b*, the arms 2 and 3 are provided with hooks 1*a* and 1*b*** serving as grippers for the handles H of a bag B represented in broken lines and adapted to be received in the holder.

Figure 2:
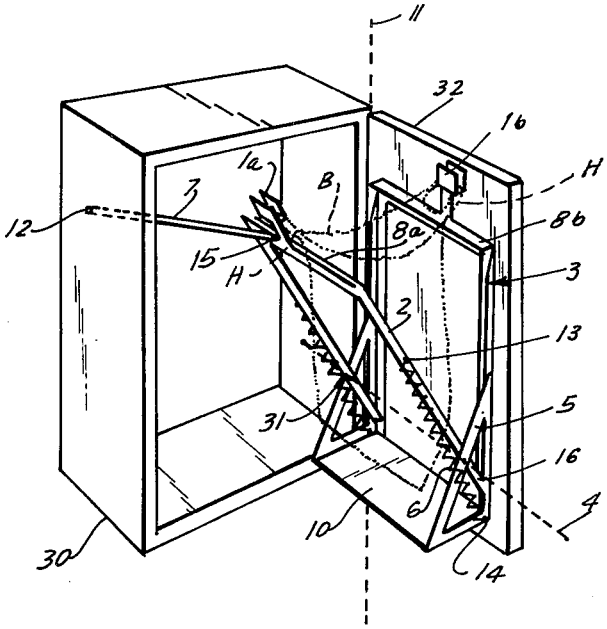
FIG. 2 is a perspective view of the cabinet including the bag holder, showing the latter in its open condition.
Figure 3:
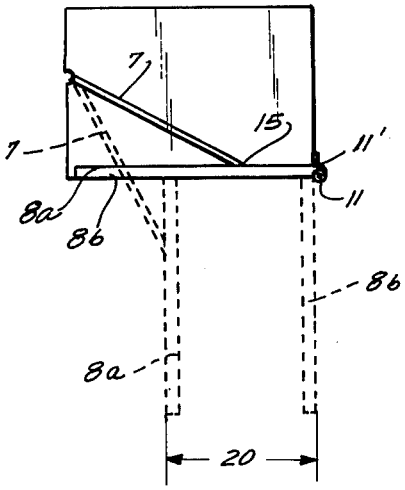
FIG. 3 is a plan view of a portion of the device according to the invention, in which the bag holder is represented by the sealing bars.

The stationary arm 3 is here shown to be mounted directly upon the door 32 of a cabinet 33, the door 32 being hinged to the cabinet by conventional hinge means not seen in FIGS. 1 and 2 but diagrammatically represented at 11' in FIG. 3 so as to swing about the vertical axis 11. The cabinet 33 is intended to fully receive the bag holder and the bag B when the door 32 is closed.

Alternatively, the door 32 can be provided with the sealing bar **8*b* and the hook 1*b* and the pivot 31** so as to constitute the stationary arm of the holder.

A pivot 12 on the exterior of the cabinet connects a traction rod 7 to a fixed location on the cabinet, the other end of the traction rod 7 being swingably connected at 15 to the sealing bar **8*b*** of the holder.

In the closed condition of the holder, best seen in FIG. 1, the sealing bars **8*b* and 8*a* approach one another to clamp the mouth of the bag B strut. However, in the open condition, the bars 8*a* and 8*b* are spaced apart (FIG. 2) while the grippers 1*a* and 1*b*** spread the handles H of the bag to hold the mouth thereof opened. Thus trash or the like can be tossed into the bag.

The traction rod 7 opens and closes the bag holder upon opening and closing of the door 32.

Traction springs 6, i.e. coil springs anchored at 13 to an upper end of the movable arm 2 and at 14 to the bottom of the fixed arm 3, tend to draw the upper end of the arm 2 toward the upper end of the arm 3. As can be seen from FIGS. 1 and 2, when the arm 2 is swung at its upper end away from the arm 3, the spring 6 can swing past the axis 4, i.e. beyond a dead point (dead-center position), to retain the holder in the open position. Of course, when the door 32 is closed, the rod 7 serves to push the upper end of the arm 2 toward the upper end of the arm 3 and thereby close the bag. In the closed position of the bag, the springs 6 lie on the other side of the dead-point position and serve to retain the bag in a closed condition.

As will also be apparent from FIGS. 1 and 2, the bar **8*b* is positioned somewhat higher than the bar 8*a* in the closed condition of the device so as to overlap the bar 8*a* and fold the bag in a sealing condition. The axis 4 lies parallel to the sealing bars 8*a* and 8*b***.

While both arms 2 and 3 have generally a frame or U-configuration, it will be apparent that either of them or both of them may be formed by a centrally positioned member as well. As is also apparent from FIG. 1, the grippers or hooks **1*a* and 1*b*** are laterally offset from one another so as not to interfere with the closing positions of the arms. Furthermore, these grippers can be constituted of a material of a high coefficient of friction, e.g. rubber, so as to restrict the tendency of the bag handles H to slip out of these grippers.

Figure 5:
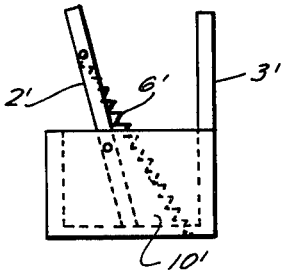
FIG. 5 is a fragmentary elevational view showing a modification of the system of FIGS. 1–3.

As can be seen from FIG. 5, in place of the plate-like bottom 10 of the device, the bottom of the fixed arm 3' can be formed with a pocket 10' adapted to accommodate the bottom of the bag so as to confine any material which might tend to leak therefrom or to emerge in the event the bottom of the bag is broken.

The rod 7 forms an acute angle with bars **8*a* and 8*b* in the closed position thereof (FIG. 3) intended to permit swinging movement of the device into the open position but preventing any jamming during the closing movement. The angle should be such as to permit a full spread of the arms 2, 3 as represented at 20. The limiting position of the two arms can also be achieved by extensions 16 of the arm 2 beyond the pivot axis 4 and engageable with the arm 3 in the open position of arm 2. It has been found to be advantageous to have the arm 7 form an angle of approximately 45° with the bars 8*a*, 8*b* in the closed position and to have the angular swing of the rod 7 also about 45° between the open and closed positions of the bars 8*a*, 8*b*. Furthermore, the rod 7 should be pivotally connected to the swingable arm 2 at a location 15 which is approximately half the spread 20 of the swingable arm and is located approximately at the level of the bars 8*a* and 8*b***.

Figure 4:
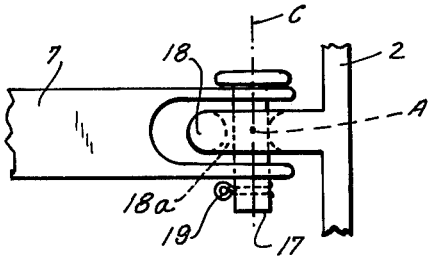
FIG. 4 is a detail view of the connection between the tension member and the movable arm.

For ease in mounting, the pivot 12 can be guided in a rail and so constructed as to be locked in place. The bars **8*a* and 8*b* can be provided with magnets or other locking means for retaining them in the closed condition until an opening force is applied, or with magnetic or other indexing means retaining the arms in the open position until a closing force is applied, The pivotal connection between the rod 7 and the swingable arm 2 at the location 15 and between the rod 7 and the cabinet at the location 12 should provide not only swinging action about a vertical axis but also swinging movement about a horizontal axis, i.e. pivotal movement with two degrees of freedom. This double hinged approach can be constructed as illustrated in FIG. 4. In this arrangement, one of the hinged members is formed with an eye 18 whose opening 18*a* receives a hinge pin or pintel 17 with play about an axis perpendicular to the plane of the paper and represented at A. The pintel 17, in turn, defines an axis C perpendicular to the axis A and parallel to the plane of the paper. The rod 7 can be provided with a pair of lugs straddling the eye 18 and accommodating the pintel 17 which is held in place by a cotter pin 19**.

I claim:

1. A bag holder for a bag provided with handles, comprising:

a support;

a first arm swingably mounted on said support about a vertical axis;

a second arm swingably mounted on said first arm about a horizontal axis, said arms being upright and having upper ends;

a sealing bar on each of the upper ends of said arms adapted to close the mouth of a bag engaged thereby;

respective bars for engagement with the handles of a bag; and a traction rod swingably mounted on said second arm and connected to said support for automatically swinging the upper end of said second arm away from the upper end of said first arm upon pivotal movement of said arm about said vertical axis, to open the mouth of said bag, said rod being hinged to both said support and said second arm with pivotal movement about two mutually perpendicular axes.

2. A bag holder for a bag provided with handles, comprising:

a support;

a first arm swingably mounted on said support about a vertical axis;

a second arm swingably mounted on said first arm about a horizontal axis, said arms being upright and having upper ends;

a sealing bar on each of the upper ends of said arms adapted to close the mouth of a bag engaged thereby;

respective gripper means on the upper ends of each of said arms above the respective bars for engagement with the handles of a bag;

a traction rod swingably mounted on said second arm and connected to said support for automatically swinging the upper end of said second arm away from the upper end of said first arm upon pivotal movement of said first arm about said vertical axis, to open the mouth of said bag, said rod being hinged to both said support and said second arm with pivotal movement about two mutually perpendicular axes; and at least one tension spring interconnecting said arms for drawing said upper ends together when said spring lies on one side of said horizontal axis and for retaining said upper end when said spring lies on another side of said horizontal axis, said spring swinging from one side to the other side upon displacement of the upper end of said second arm away from the upper end of said first arm.

3. The bag holder defined in claim 2 wherein said first arm is formed with a support plate at the bottom thereof to receive the bottom of a bag.

4. The bag holder defined in claim 3, further comprising a pocket formed in the lower end of said first arm for receiving the bottom of said bag.

5. The bag holder defined in claim 2 wherein said second arm is formed with an extension beyond said horizontal axis for engagement with said first arm to limit the spread of its upper end from the upper end of said first arm.

6. The bag holder defined in claim 5 wherein said support is a cabinet and said first arm forms of the door of said cabinet.

7. The bag holder defined in claim 6 wherein said first arm is mounted on a door of said cabinet.

8. The bag holder defined in claim 7 wherein said bars are disposed one above the other so as to overlap in a closed condition of said bag, said gripper means being laterally spaced apart.

* * * * *